US009219338B2

(12) United States Patent
Sagayama et al.

(10) Patent No.: US 9,219,338 B2
(45) Date of Patent: Dec. 22, 2015

(54) LOW PROFILE CONNECTOR

(71) Applicant: Molex, LLC, Lisle, IL (US)

(72) Inventors: Akira Sagayama, Yamato (JP); Toshihiro Niitsu, Machida (JP)

(73) Assignee: Molex, LLC, Lisle, IL (US)

( * ) Notice: Subject to any disclaimer, the term of this patent is extended or adjusted under 35 U.S.C. 154(b) by 59 days.

(21) Appl. No.: 13/928,585

(22) Filed: Jun. 27, 2013

(65) Prior Publication Data

US 2014/0004752 A1 Jan. 2, 2014

(30) Foreign Application Priority Data

Jun. 27, 2012 (JP) ..... 2012-144419

(51) Int. Cl.
*H01R 12/00* (2006.01)
*H01R 24/00* (2011.01)
*H01R 12/89* (2011.01)

(52) U.S. Cl.
CPC ..... *H01R 24/005* (2013.01); *H01R 12/89* (2013.01)

(58) Field of Classification Search
CPC ..... H01R 23/722; H01R 23/725; H01R 23/7073; H05K 7/1069; H05K 7/1092; H05K 7/1084; H05K 3/368
USPC ..... 439/66, 68, 69, 70, 74, 75, 660
See application file for complete search history.

(56) References Cited

U.S. PATENT DOCUMENTS

| | | | | |
|---|---|---|---|---|
| 5,939,455 | A * | 8/1999 | Rephaeli | 514/547 |
| 7,674,114 | B2 * | 3/2010 | Tanaka et al. | 439/74 |
| 8,137,114 | B1 * | 3/2012 | Peng | 439/74 |
| 8,465,328 | B2 * | 6/2013 | Iida et al. | 439/660 |

FOREIGN PATENT DOCUMENTS

| | | | |
|---|---|---|---|
| JP | 2008027713 | A * | 2/2008 |
| JP | 2008-270100 | | 11/2008 |

* cited by examiner

*Primary Examiner* — Thanh Tam Le

(57) ABSTRACT

A connector characterized in that it: is a connector that has a plurality of plate-shaped terminals that include openings able to enclose protruding terminals of the other half of the connector, and that mates with the other half of the connector. The openings comprise a wide portion, a narrow portion and a transitional portion that transitions from the wide portion to the narrow portion, and, in a top view, are provided with a first shape that is left-right asymmetric with respect to the centerline of the plate-shaped terminals, or a second shape whereby the first shape is inverted about the centerline. The plate-shaped terminals are arrayed lined up in the width direction of the connector, and arrayed such that the plate-shaped terminals comprising an opening having the first shape and the plate-shaped terminals comprising an opening having the second shape alternate.

20 Claims, 13 Drawing Sheets

LOW PROFILE CONNECTOR

REFERENCE TO RELATED APPLICATIONS

The Present Disclosure claims priority to prior-filed Japanese Patent Application No. 2012-144419, entitled "Connector," filed on 27 Jun. 2012 with the Japanese Patent Office. The content of the aforementioned patent application is incorporated in its entirety herein.

BACKGROUND OF THE PRESENT DISCLOSURE

The Present Disclosure relates, generally, to a connector.

Conventionally, in personal electronic equipment, in order to handle the greater miniaturization and increased performance of the devices and components, demands have been made of connectors too for greater miniaturization and higher density. In order to meet these demands, there have been proposals to form a plurality of conductor patterns upon insulating substrates and provide connectors that connect the ends of these conductor patterns to other substrates and the like. An example is disclosed in Japanese Patent No. 2007-114710, the content of which is hereby incorporated by reference in its entirety.

FIG. 13 is a perspective view of a conventional connector. In the figure, 911 is a male-side body serving as the body of the male connector, mounted to the surface of a circuit board (not shown). Upon the male-side body 911 are formed terminal-enclosing openings 954 that communicate between the front and rear surfaces of the male-side body 911, and within the terminal-enclosing openings 954 are disposed a plurality of male-side electrode patterns 951 lined up in the lateral direction at a stipulated spacing. Each male-side electrode pattern 951 is provided with a tail portion 958 extending toward the outside of the male-side body 911, and each tail portion 958 is electrically connected to a conductor trace of the electrical circuits formed on the surface of the circuit board. In addition, each male-side electrode pattern 951 is provided with an arm portion 953 that demarcates an inside opening 954*a* and the periphery of the inside opening 954*a*. Moreover, the inside opening 954*a* is provided with a narrow portion having a narrow width and a wide portion having a wide width formed in the vicinity of the narrow portion.

Moreover, in the initial stage of the mating process, a male connector (not shown) is moved with respect to the female connector in the direction of the thickness of the female connector (the direction perpendicular to the drawing) and mates. At this time, bump-shaped male-side electrode protrusions (not shown) that protrude from the surface of the female connector enter into the wide portions of the inside openings 954*a*. Then, when the male connector is moved with respect to the female connector in the longitudinal direction in the Figure, the male-side electrode protrusions move into the narrow portions. Thereby the mating of the male connector and the female connector is complete.

However, in the conventional connector, due to the effects of tolerances in manufacture and the like, positioning errors in the male-side electrode protrusions and positioning errors in the terminal-enclosing openings 954 of the male-side electrode patterns 951 may occur. If such positioning errors occur, there is a risk of excessive shaving or deformation of the male-side electrode protrusions or terminal-enclosing openings 954 occurring. In particular, as the electrodes are miniaturized or given higher densities accompanying progress in the miniaturization or increase in density of connectors, the problems arising due to positioning errors related to the dimensions and positions of electrodes become greater.

SUMMARY OF THE PRESENT DISCLOSURE

The Present Disclosure has, as an object, to solve the aforementioned problems with the conventional connectors and provide a connector highly reliable while still compact and low profile whereby, by giving the shapes of the openings of plate-shaped terminals that engage with the protruding terminals of the other half of the connector left-right asymmetry, it is possible to appropriately absorb any positioning error, so it is possible to prevent excessive shaving or deformation of the protruding terminals or plate-shaped terminals.

To this end, the connector according to the Present Disclosure comprises a connector that has a plurality of plate-shaped terminals that include openings able to enclose protruding terminals of the other half of the connector, and that mates with the other half of the connector. The openings comprise a wide portion, a narrow portion and a transitional portion that transitions from the wide portion to the narrow portion, and, in a top view, are provided with a first shape that is left-right asymmetric with respect to the centerline of the plate-shaped terminals, or a second shape whereby the first shape is inverted about the centerline. The plate-shaped terminals are arrayed lined up in the width direction of the connector, and arrayed such that the plate-shaped terminals comprising an opening having the first shape and the plate-shaped terminals comprising an opening having the second shape alternate.

Another connector according to the Present Disclosure comprises one where the transitional portions include an early contact portion formed upon either the left or right side of the centerline, and a late contact portion formed upon the other side, and at the time of moving from the wide portion to the narrow portion, the protruding terminals first contact the early contact portions and then contact the late contact portions.

Still another connector according to the Present Disclosure comprises one where the transitional portions include an early induction portion connected to the early contact portion and a late induction portion connected to the late contact portion, and the early and late induction portions are inclined portions inclined with respect to the centerline, and the inclination of the early induction portion is steeper than that of the late induction portion.

Still another connector according to the Present Disclosure comprises one where the plate-shaped terminals are arrayed to form a plurality of rows extending in the width direction of the connector, and the rows are formed such that rows made up of plate-shaped terminals comprising openings given the first shape alternate with rows made up of plate-shaped terminals comprising openings given the second shape.

Still another connector according to the Present Disclosure comprises one where the plate-shaped terminals include openings given the first shape and the plate-shaped terminals include openings given the second shape are defined to alternate with respect to the width direction of the connector.

Still another connector according to the Present Disclosure comprises one where the connector further has a connector engagement tab extending toward the outside in the width direction, and a latch protrusion protruding toward the outside in the width direction of the connector is formed upon the connector engagement tab, the other half of the connector has connector engagement cavities that engage the connector engagement tab disposed on either side in the width direction, and other-half latch protrusions that protrude toward the center in the width direction of the other half of the connector are formed upon the connector engagement cavities. When the other half of the connector is moved relative to the connector in the direction such that the protruding terminals enclosed within the openings move in the direction from the wide portions to the narrow portions, the latch protrusions ride up over the other-half latch protrusions.

With the Present Disclosure, the shapes of the openings of plate-shaped terminals that engage the protruding terminals of the other half of the connector are given left-right asymmetry. Thereby, it is possible to appropriately absorb any positioning error, to prevent excessive shaving or deformation of the protruding terminals or plate-shaped terminals, and to increase its reliability while still remaining compact and low profile.

BRIEF DESCRIPTION OF THE FIGURES

The organization and manner of the structure and operation of the Present Disclosure, together with further objects and advantages thereof, may best be understood by reference to the following Detailed Description, taken in connection with the accompanying Figures, wherein like reference numerals identify like elements, and in which.

DESCRIPTION OF THE PREFERRED EMBODIMENTS

While the Present Disclosure may be susceptible to embodiment in different forms, there is shown in the Figures, and will be described herein in detail, specific embodiments, with the understanding that the Present Disclosure is to be considered an exemplification of the principles of the Present Disclosure, and is not intended to limit the Present Disclosure to that as illustrated.

As such, references to a feature or aspect are intended to describe a feature or aspect of an example of the Present Disclosure, not to imply that every embodiment thereof must have the described feature or aspect. Furthermore, it should be noted that the description illustrates a number of features. While certain features have been combined together to illustrate potential system designs, those features may also be used in other combinations not expressly disclosed. Thus, the depicted combinations are not intended to be limiting, unless otherwise noted.

In the embodiments illustrated in the Figures, representations of directions such as up, down, left, right, front and rear, used for explaining the structure and movement of the various elements of the Present Disclosure, are not absolute, but relative. These representations are appropriate when the elements are in the position shown in the Figures. If the description of the position of the elements changes, however, these representations are to be changed accordingly.

Figure 1:
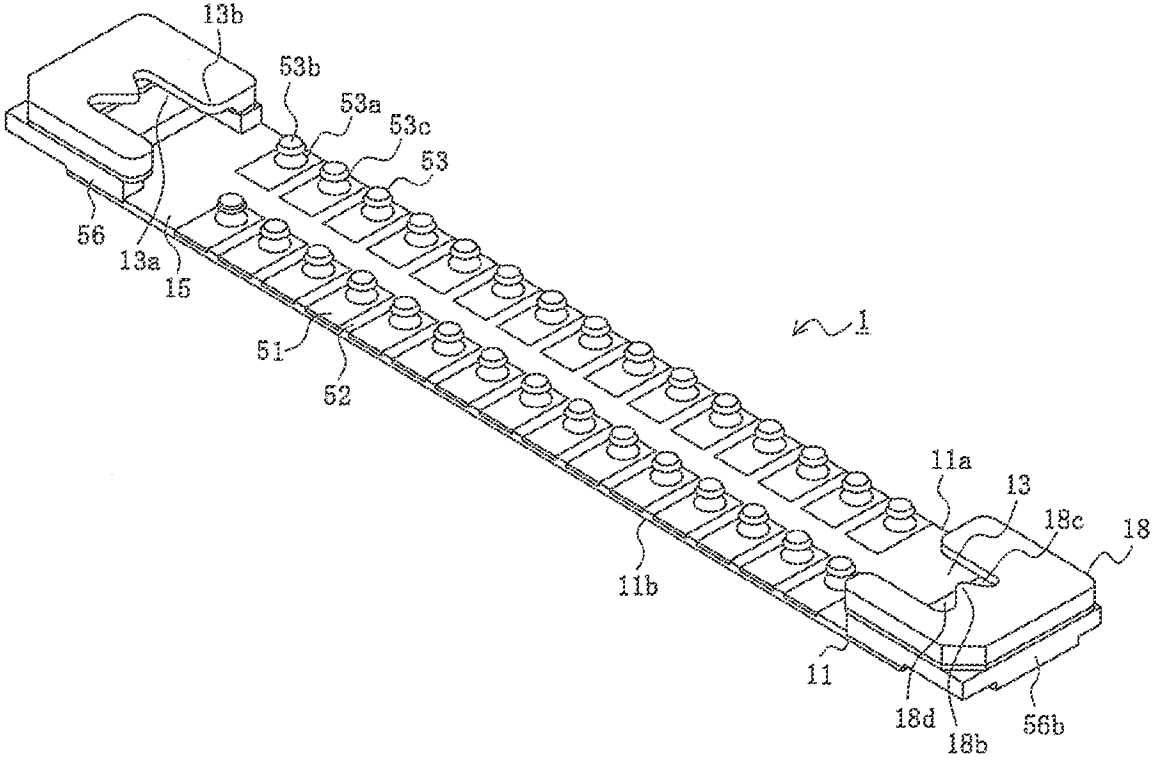
FIG. 1 is a perspective view of a male connector in an embodiment of the Present Disclosure.
Figure 2:
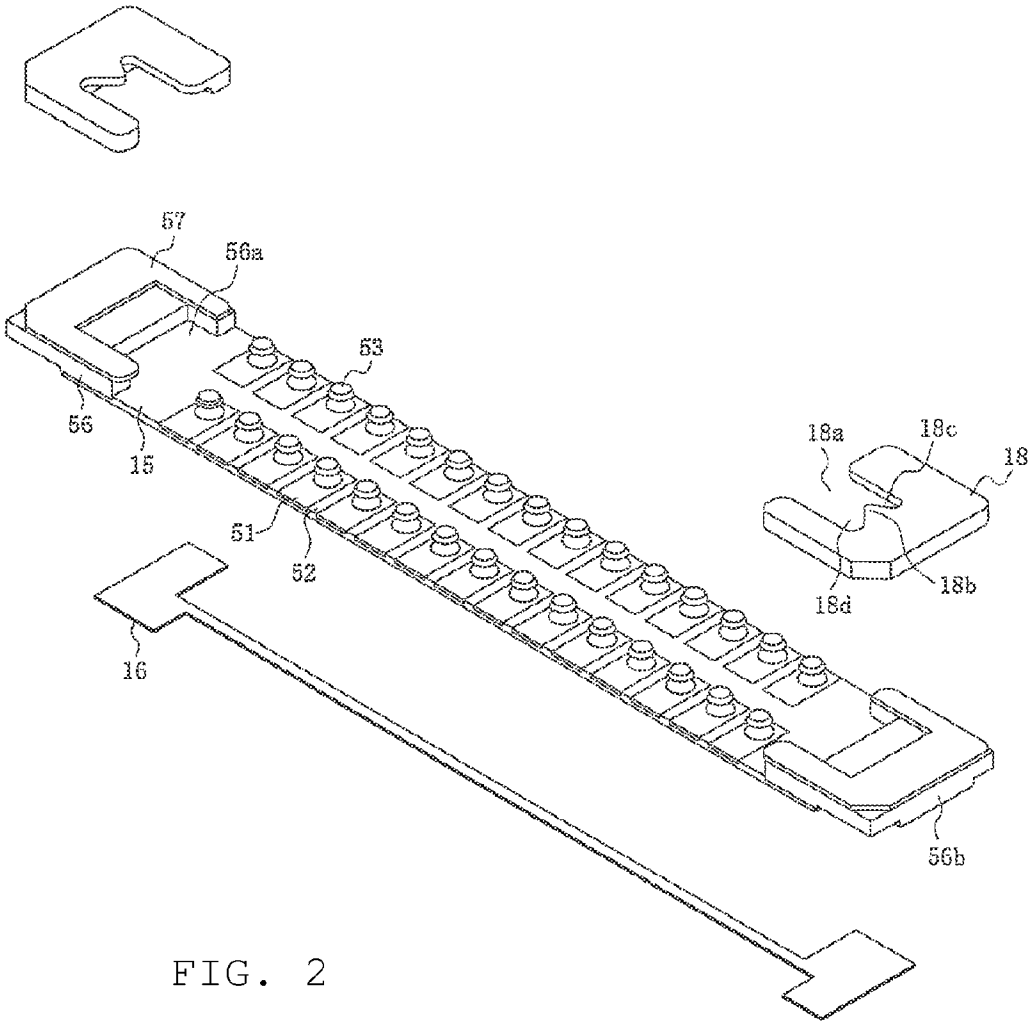
FIG. 2 is an exploded view of the male connector of FIG. 1, showing its laminar structure.

Referring to FIGS. 1-2, 1 is a male connector as a first connector which is one half of the connector according to the Present Disclosure; being a connector that is mounted on the surface of a mounted member (not shown), and that mates to and is electrically connected to a female connector 101 as the second connector (to be described later). Moreover, the male connector 1 which is the other half of the connector to the female connector 101 has a plate-shaped main unit 11 with a rectangular shape in top view. This main unit 11 has, starting from the mounting surface side (non-mating surface side) (lower side in FIGS. 1-2), a reinforcing layer 16 as a plate-shaped reinforcing plate which is a flat thin-plate member, a base film 15 as the male base plate portion which is a plate-shaped first base plate portion which is an insulating thin-plate member given a long, thin strip shape, and a plurality of conductor patterns 51 as male conductors which are flat plate-shaped terminal members disposed upon one face of this base film 15 (the face on the mating surface side). These conductor patterns 51 are isolated from each other by pattern isolation gaps 52.

The base film 15 may be made of, for example, any insulating material. In addition, a reinforcing layer 16 as a plate-shaped reinforcing plate which is a flat thin-plate member is disposed upon the other surface of the base film 15 (the face on the mounting surface side). This reinforcing layer 16 may be made of, for example, metal, but may also be of any type. Moreover, the conductor patterns 51 may be, for example, formed from foil with a thickness of several to several dozen μm applied in advance to one face of the base film 15, and then etched or otherwise patterned, with the patterns arrayed in lines so as to form two rows that are isolated from each other along the front edge 11*a* and rear edge 11*b* extending in the longitudinal direction of the main unit 11, the lateral direction (width direction) of the male connector 1, where the adjacent conductor patterns 51 within each row are isolated from each other and arrayed at a stipulated pitch. In addition, the row along the front edge 11*a* and the row along the rear edge 11*b* are disposed offset from each other by one half of the pitch in the longitudinal direction of the main unit 11. To wit, the conductor patterns 51 within the row along the front edge 11*a* and within the row along the rear edge 11*b* are arrayed so that they assume a zigzag pattern offset by one half the pitch from each other in the lateral direction (width direction) of the male connector 1.

The conductor patterns 51 are plate-shaped terminal patterns disposed in parallel rows, being exposed to the mating surface of the main unit 11 and also being provided with one protruding terminal 53 apiece as a male terminal. Note that in the illustrated rows, the conductor patterns 51 and protruding terminals 53 are arrayed in lines at a stipulated pitch, for example, roughly 0.4 mm, so as to form two rows that extend in the width direction of the main unit 11, but the numbers of the conductor patterns 51 and protruding terminals 53, their pitch and other aspects of the array are in no way limited to those illustrated in the Figures. Each protruding terminal 53 protrudes from the surface of the conductor patterns 51, being formed integrally with the conductor patterns 51 by a method such as, for example, etching using photolithographic techniques. Note that the dimensions of the protruding terminal 53 in the height direction may be, for example, roughly 0.1-0.3 mm.

In addition, the shapes of the upper surfaces and cross sections of the protruding terminals 53 are preferably such that the dimensions in the front-back direction are greater than the dimensions in the width direction. Moreover, it is even more preferable for them to have a shape such as that of a pentagon like the home plate used in baseball with the front protruding, or such as a hexagon, or namely a shape with an inclined portion in front.

In this embodiment, the shapes of the side surfaces of the protruding terminals 53 are preferably concave surfaces as shown in FIG. 1. Specifically, in the protruding terminals 53, the width dimension of the base portion 53*a* which is the portion connected to the surface of the conductor patterns 51 is equal to or greater than the width dimension of the tip portion 53*b* which is the upper tip, while the side wall portion 53*c* between the base portion 53*a* and the tip portion 53*b* is a smooth wall whose shape is smoothly indented toward the inside in the width direction further than in the base portion 53*a* and tip portion 53*b*. Note that the shape of the side wall portion 53*c* is preferably a gently continuous curve, but it may also be a continuous bent surface made up of a plurality of inclined planes.

In addition, each conductor pattern 51 is electrically connected via a through-hole or the like formed in the base film 15, for example, to a corresponding mounting pattern disposed on the other face of the base film 15 (the face on the mounting surface side). Moreover, each mounting pattern is connected by soldering or other means to a connection pad formed on the surface of the board as the mounted member. Thereby, the male connector 1 is attached to the board and the conductor patterns 51 and protruding terminals 53 are electrically connected to the connection pads of the board. Note that instead of the mounting pattern, it is possible to form on each of the conductor patterns 51*a* tail portion that extends in the lateral direction of the main unit 11 and protrudes outward from the base film 15, and connect these tail portions to the connection pads of the board.

In addition, an auxiliary bracket 56 is disposed to one side of the conductor patterns 51. This auxiliary bracket 56 may be, for example, formed together with the conductor patterns 51 from foil with a thickness of several to several dozen μm applied in advance to one face of the base film 15, and then etched or otherwise patterned, extending in the lateral direction of the main unit 11 and disposed isolated from the conductor patterns 51 at either end of the main unit 11 in the lengthwise direction. Upon each auxiliary bracket 56 is formed an entry cavity 56*a* into which enters the connector engagement tab 113 of the female connector 101 (to be described later) and a securing tab 56*b* that extends outward in the lengthwise direction of the main unit 11. Moreover, the rear surface of the securing tab 56*b* is exposed upon the mounting surface of the main unit 11, and this exposed portion is connected by soldering or the like to a securing pad formed on the surface of the board. Thereby, the male connector 1 is solidly attached to the male connector 1.

An engagement reinforcing plate 18 as a flat plate-shaped engagement member is disposed upon the surface of the auxiliary bracket 56 (the face on the mating surface side). This engagement reinforcing plate 18 may be made of, for example, metal, but may also be any other type. In addition, an entry cavity 18*a* into which the connector engagement tab 113 of the female connector 101 enters is formed upon each engagement reinforcing plate 18. Moreover, the engagement reinforcing plate 18 is joined and secured to the surface of the auxiliary bracket 56 with a flat plate-shaped spacer member 57 interposed. In this case, the entry cavity 18*a* is disposed at a position corresponding to the entry cavity 56*a*, so as shown in FIG. 1, a connector engagement cavity 13 that engages with the connector engagement tab 113 of the female connector 101 is formed. Note that the dimensions of the entry cavity 18*a* are smaller than the dimensions of the entry cavity 56*a*, so a visor-shaped detent 13*b* and a detent cavity 13*a* covered by the detent 13*b* are formed at areas toward the front edge 11*a* of the main unit 11 in the connector engagement cavity 13.

Moreover, a latch protrusion 18*b* is formed on the sidewall positioned behind the connector engagement cavity 13 through the entry cavity 18*a*, as an other-half latch protrusion that protrudes toward the center of the male connector 1 in the width direction. This latch protrusion 18*b* is given a triangular-shaped flat shape. Moreover, the portion of the entry cavity 18*a* toward the front edge 11*a* of the latch protrusion 18*b* and the portion toward the rear edge 11*b* constitute a front-side latch cavity 18*c* and a rear-side latch cavity 18*d*. The inclined surface of the rear side of the triangular-shaped latch protrusion 18*b* (the rear-side latch cavity 18*d* side) is preferably formed such that the inclination is gentler than the inclined surface of the front side (the front-side latch cavity 18*c* side).

Figure 3A:
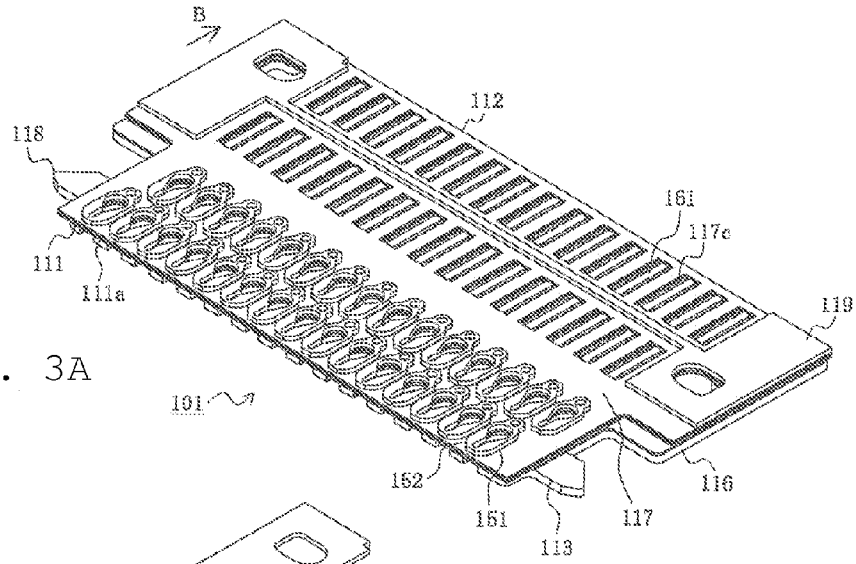
FIG. 3 is a view of the mating surface side showing a female connector in an embodiment of the Present Disclosure, where (a) is a perspective view and (b) is an exploded view.
Figure 3B:
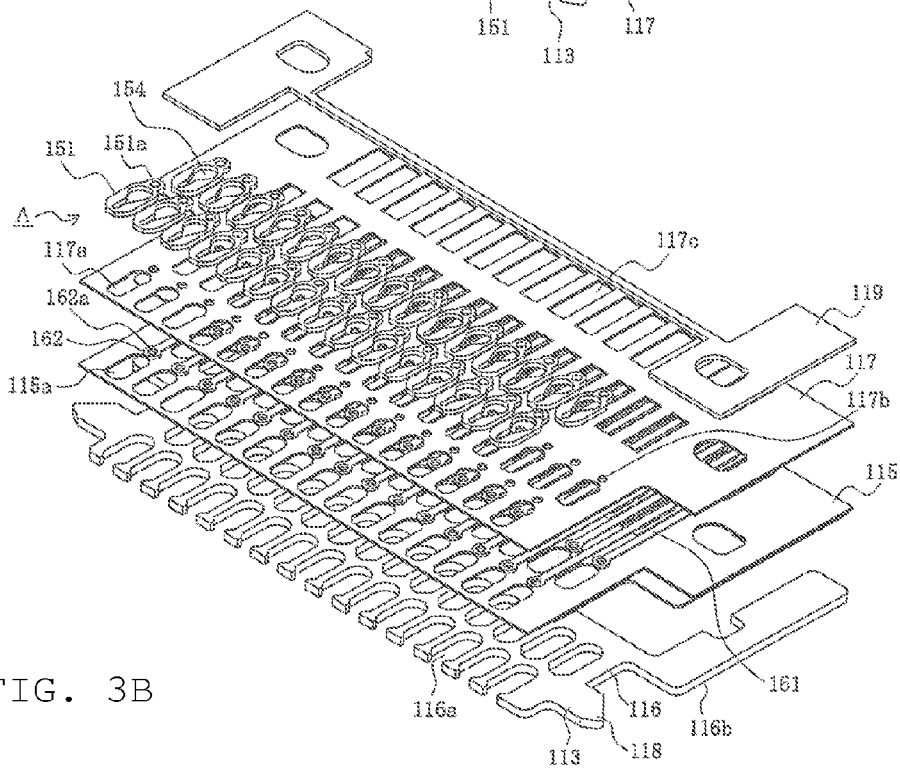
Figure 4:
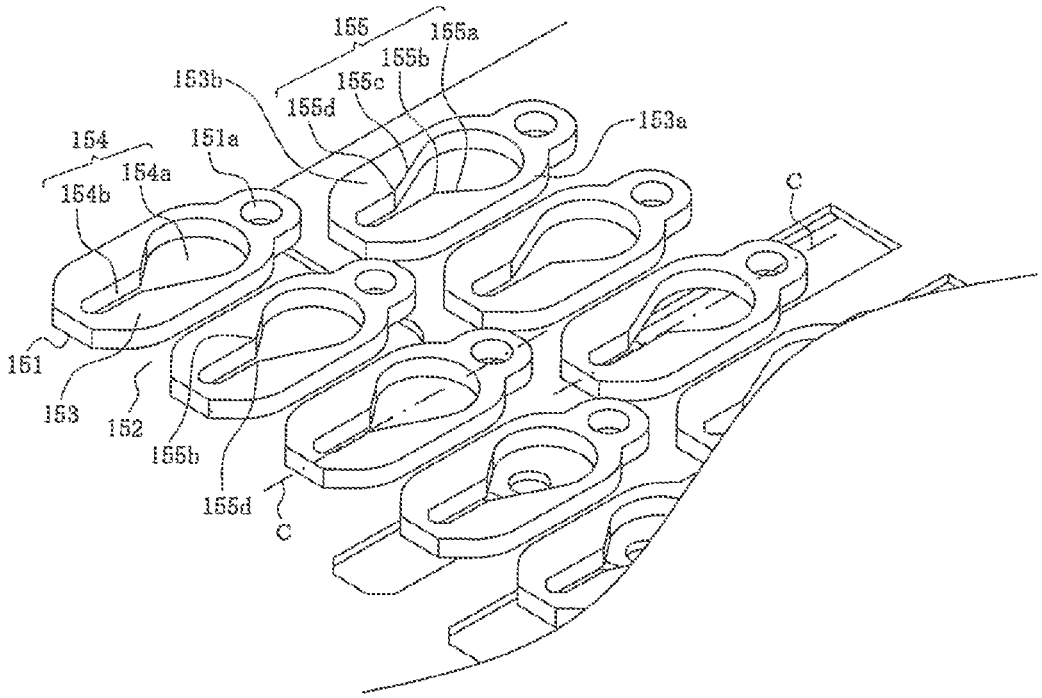
FIG. 4 is an enlarged view of Area A of FIG. 3, showing an enlarged view of the female connector of FIG. 3.
Figure 5A:
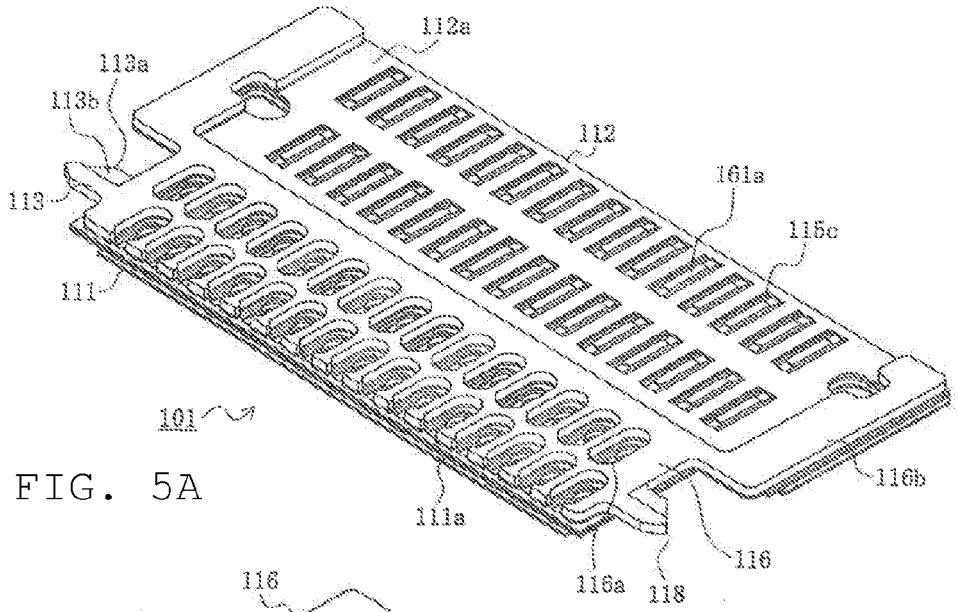
FIG. 5 is a view of the non-mating surface side showing the female connector of FIG. 3, where (a) is a perspective view and (b) is an exploded view.
Figure 5B:
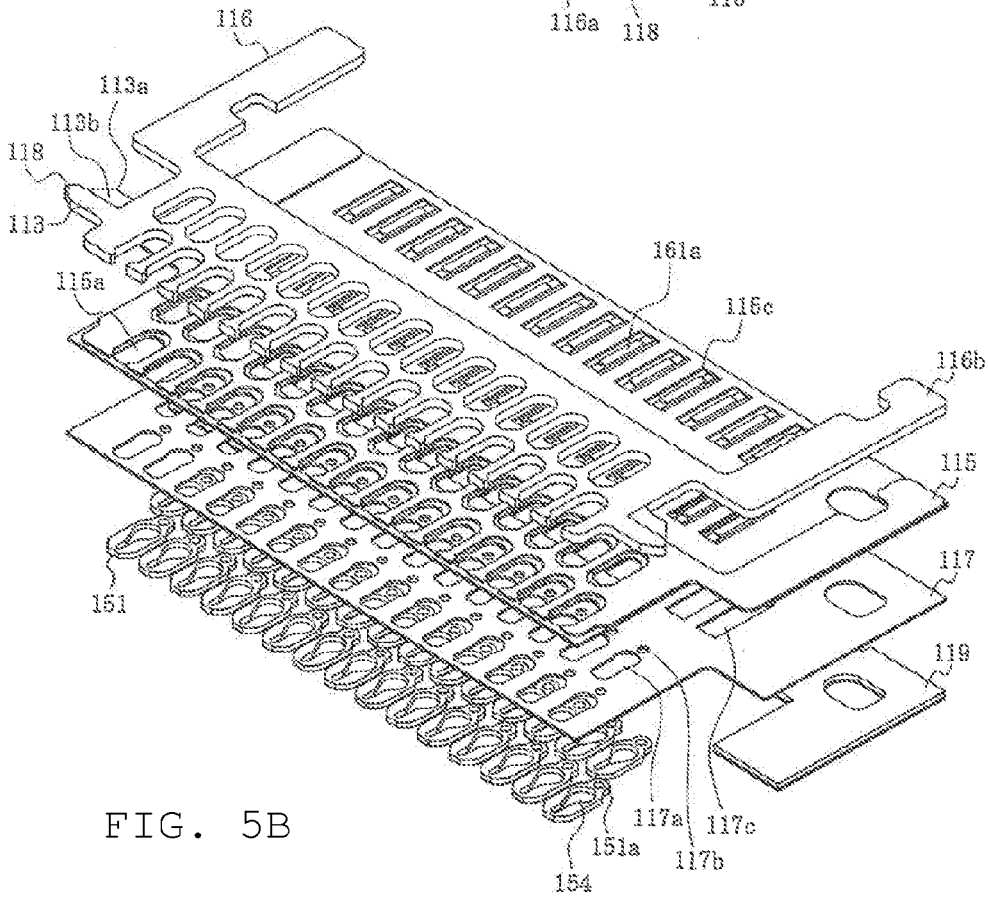

Referring now to FIGS. 3-5, the female connector 101 is a second connector as the other half of the connector, which is given a rectangular flat shape and which mates with and is electrically connected to the male connector 1 as its other half of the connector. In addition, the female connector 101 may be, for example, mounted to a printed circuit board, flexible flat cables, flexible printed circuit boards or other mounted member, but here is described as connected to the end of a flexible flat cable, flexible printed circuit board or other flat cable.

In the illustrated example, the female connector 101 has a flat cable portion 112 and a plate-shaped main-unit portion 111 as the connecting portion formed upon or connected to the end of this cable portion 112. Moreover, the main-unit portion 111 and cable portion 112 have, from the non-mating surface side (the lower side in FIG. 3) an engagement reinforcing plate 116 as a reinforcing plate made of a plate-shaped member, a base film 115 as an insulating layer which is a plate-shaped female base made of an insulating thin-plate member common to the cable portion 112, wiring 161 comprising a plurality of conducting wires provided in parallel upon one surface of this base film 115 (the upper surface in FIG. 3(*b*)), a cover film 117 as an insulating layer that is made of an insulating thin-plate member common to the cable portion 112 and is a plate-shaped female covering that covers the wiring 161, a plurality of plate-shaped terminals 151 as female conductor portions which are plate-shaped terminal members, and a reinforcing layer 119 made up of a plate-shaped member. Note that the plate-shaped terminals 151 are present only on the main-unit portion 111, while the reinforcing layer 119 is present only on the cable portion 112.

The plate-shaped terminals 151 have substantially elliptical to oval-shaped flat shapes, being isolated from each other by terminal isolation gaps 152. In addition, each of the wires in the wiring 161 is electrically connected to a conducting trace corresponding to the flat cable. Note that the preferred dimension in the thickness direction of the main-unit portion 111 is approximately 0.3-0.5 mm. The base film 115 and cover film 117 may be made of, for example, any type of insulating material. In addition, the engagement reinforcing plate 116 and reinforcing layer 119 may be made of, for example, metal or any other type of material.

Moreover, the wiring 161 may be, for example, formed from foil with a thickness of several to several dozen μm applied in advance to one face of the base film 115, and then etched or otherwise patterned, with the patterns arrayed in lines so as to form two rows parallel to each other. In addition, the plate-shaped terminals 151 may be, for example, formed from foil with a thickness of several to several dozen μm applied in advance to one face of the base film 117, and then etched or otherwise patterned, with the patterns arrayed in lines so as to form two rows parallel to each other that are isolated from each other along the front edge 111*a* and rear edge 111*b* extending in the lateral direction (width direction) of the female connector 101, where the rows and the adjacent plate-shaped terminals 151 within each row are isolated from each other and arrayed at a stipulated pitch. Note that this pitch is set to be equal to the pitch of the conductor patterns 51 of the male connector 1 and the pitch of the wiring 161.

Moreover, the row along the front edge 111*a* and the row toward the cable portion 112 are disposed offset from each other by one half of the pitch in the lateral direction of the female connector 101. To wit, the plate-shaped terminals 151 within the row along the front edge 111*a* and the plate-shaped terminals 151 within the row toward the cable portion 112 are arrayed so that they assume a zigzag pattern offset by one half the pitch from each other in the lateral direction of the female connector 101.

As shown in FIG. 4, the plate-shaped terminals 151 have openings 154 for enclosing protruding terminals that have a substantially sake bottle-shaped planar shape, arms 153 as first terminal members that demarcate the left and right sides of the openings 154, terminal connecting holes 151*a*, and left-right asymmetrical planar shapes or namely planar shapes that are not linearly symmetrical. The centerline C of each of the plate-shaped terminals 151 is aligned with the centerline of the corresponding wire of the wiring 161 in top view, and the center of the terminal connecting holes 151*a* is also positioned upon the centerline of the corresponding wire of the wiring 161. Note that the openings 154 penetrate through the plate-shaped terminals 151 in the direction of the board thickness. Moreover, the external shapes of the plate-shaped terminals 151 are left-right symmetrical planar shapes with the centerline C as the axis of symmetry, but the openings 154 have left-right asymmetrical planar shapes with respect to the centerline C.

The openings 154 are the portions that, when the plate-shaped terminals 151 mate with the protruding terminals 53 of the male connector 1, enclose the entering protruding terminals 53. Moreover, the openings 154 comprise a substantially elliptical to ovoid wide portion 154*a*, and a channel-shaped narrow portion 154*b* connected to this wide portion 154*a* on the front edge 111*a* side of the main-unit portion 111 and that extends toward this front edge 111*a*. Note that the centers in the width direction of the wide portion 154*a* and narrow portion 154*b* are positioned upon the centerline C.

The wide portions 154*a* are the portions into which the protruding terminals 53 enter starting from their tip portions 53*b*, and their inside portions are formed so that their dimensions are greater than the outside dimensions of the tip portion 53*b* of the protruding terminals 53. Thereby, when the plate-shaped terminals 151 mate with the protruding terminals 53, the protruding terminals 53 can smoothly enter the interiors of the wide portions 154*a*. In addition, when the female connector 101 is slid in the direction indicated by Arrow B in FIG. 3 relative to the male connector 1, the narrow portions 154*b* are the portions into which the protruding terminals 53 entering the wide portions 154*a* move. The width dimensions of the narrow portions 154*b* are the same or somewhat smaller than the diameters or width dimensions of the side wall portions 53*c* of the protruding terminals 53, and are formed such that their width dimensions are smaller than the widths of the tip portions 53*b*. For this reason, when the protruding terminals 53 enter within the narrow portions 154*b*, the arms 153 on both sides come into contact with the side wall portions 53*c* of the protruding terminals 53 and are elastically displaced so that the gap between is widened. Accordingly, the protruding terminals 53 are subject to contact pressure from the arms 153, and thus the continuity between the protruding terminals 53 and plate-shaped terminals 151 is reliably maintained.

Moreover, a transitional portion 155 that transitions from the wide portion 154*a* to the narrow portion 154*b* is formed such that its width dimension decreases gradually as it gets closer to the narrow portion 154*b*, and it has a left-right asymmetric plan shape. One of the left or right side faces of the transitional portion 155 is a first inclined portion 155*a* as the early induction portion, and the boundary between this first inclined portion 155*a* and the narrow portion 154*b* is a first vertex 155*b* as the early contact portion connected to the early induction portion. In addition, the other side face of the transitional portion 155 is a second inclined portion 155*c* as the late induction portion, and the boundary between this second inclined portion 155*c* and the narrow portion 154*b* is a second vertex 155*d* as the late contact portion connected to the late induction portion.

The first inclined portion 155*a* has a steeper inclination than the second inclined portion 155*c* (the angle of inclination with respect to the centerline C is greater), and as a result, the first vertex 155*b* is positioned behind the second vertex 155*d* (toward the cable portion 112). For this reason, when the female connector 101 is slid in the direction indicated by Arrow B in FIG. 3 relative to the male connector 1, each protruding terminal 53 within the wide portion 154*a* first comes into contact with the first inclined portion 155*a* and first vertex 155*b* and then comes into contact with the second inclined portion 155*c* and second vertex 155*d*, and moves within the narrow portion 154*b*. Thereby, even if there is positioning error in the plate-shaped terminals 151 or the corresponding protruding terminals 53 due to the effects of manufacturing tolerances or the like, the protruding terminals 53 always first come into contact with the first inclined portion 155*a* and first vertex 155*b* so the first arm 153*a*, which is the arm 153 on the side where the first inclined portion 155*a* and first vertex 155*b* are formed, starts to elastically deform before the second arm 153*b* which is the other arm 153, so the positioning error can be absorbed.

In the illustrated example, in all of the plate-shaped terminals 151 within the row along the front edge 111*a*, the first inclined portion 155*a* and first vertex 155*b* are formed on the left side of the centerline C when seen from the front edge 111*a*, while in all of the plate-shaped terminals 151 within the row toward the cable portion 112, the first inclined portion 155*a* and first vertex 155*b* are formed on the right side of the centerline C when seen from the front edge 111*a*. In other words, if the openings 154 of the plate-shaped terminals 151 within the row along the front edge 111*a* are given a first shape which is left-right asymmetrical with respect to the centerline C, then the openings 154 of the plate-shaped terminals 151 within the row toward the cable portion 112 are given a second shape which is the first shape inverted about the centerline C. To wit, the row along the front edge 111*a* is made up of plate-shaped terminals 151 that include openings 154 given the first shape, while the row toward the cable portion 112 is made up of plate-shaped terminals 151 that include openings 154 given the second shape. Thus, the plate-shaped terminals 151 are arrayed such that rows made up of plate-shaped terminals 151 that include openings 154 given the first shape and rows made up of plate-shaped terminals 151 that include openings 154 given the second shape are formed alternately.

Originally, the row along the front edge 111*a* and the row toward the cable portion 112 are disposed offset from each other by one half of the pitch in the lateral direction (width direction) of the female connector 101, so if we focus upon the width direction of the female connector 101, we can also say that rows made up of plate-shaped terminals 151 that include openings 154 given the first shape and rows made up of plate-shaped terminals 151 that include openings 154 given the second shape are disposed such that they alternate regarding the width direction of the female connector 101. Note that this can also be changed such that the row along the front edge 111*a* is made up of plate-shaped terminals 151 that include openings 154 given the second shape, while the row toward the cable portion 112 is made up of plate-shaped terminals 151 that include openings 154 given the first shape.

In this manner, by making rows made up of plate-shaped terminals 151 that include openings 154 given the first shape and rows made up of plate-shaped terminals 151 that include openings 154 given the second shape disposed such that they alternate, or namely, by arraying the plate-shaped terminals 151 such that the position on the first arm 153*a* at which are formed the first inclined portion 155*a* and first vertex 155*b* where the protruding terminals 53 contact first is inverted left-right on each adjacent row, or each plate-shaped terminal 151 which is adjacent in the lateral direction, the force in the lateral direction that the protruding terminals 53 and plate-shaped terminals 151 receive mutually from the other half is equalized over the whole. Accordingly, the states of the male connector 1 and female connector 101 mating to each other are stable, and all of the protruding terminals 53 and plate-shaped terminals 151 are stably in contact with no occurrence of the so-called "tilted mating."

A terminal-corresponding opening 117*a* and a through hole 117*b* are formed in the cover film 117 at positions corresponding to each opening 154 and terminal connecting hole 151*a* of each plate-shaped terminal 151. To wit, the terminal-corresponding openings 117*a* and through holes 117*b* are, like the plate-shaped terminals 151, arrayed in a zigzag pattern in two rows offset by one half pitch from each other. The terminal-corresponding openings 117*a* and through holes 117*b* penetrate through the cover film 117 in the direction of the board thickness. In addition, the terminal-corresponding openings 117*a* have substantially elliptical to oval-shaped flat shapes, being formed at a size larger than the openings 154 but smaller than the external size of the plate-shaped terminals 151. Moreover, wiring-corresponding openings 117*c* that penetrate the cover film 117 in the board thickness direction at positions corresponding to each wire of the wiring 161 are formed in portions corresponding to the cable portion 112 in the base film 115. The mating-side surface of the corresponding wire of the wiring 161 is exposed to each of these wiring-corresponding openings 117*c*. Note that the wiring-corresponding openings 117*c* may also be omitted if not necessary.

A substantially circular connection tip 162 is formed at the tip of each wire of the wiring 161, and a wiring connection hole 162*a* is formed on this connection tip 162. This wiring connection hole 162*a* is positioned such that its center is upon the centerline of the wiring 161 and penetrates the wiring 161 in the board thickness direction. In addition, each wire of the wiring 161 is disposed such that its wiring connection hole 162*a* is at a position corresponding to the corresponding terminal connecting hole 151*a* of the plate-shaped terminal 151 and through hole 117*b* of the cover film 117. Moreover, each of the terminal connecting holes 151*a* of the plate-shaped terminals 151 belonging to the first layer on the upper surface side of the cover film 117, or namely the mating side, communicates with the wiring connection hole 162*a* of the corresponding wire of the wiring 161 belonging to the third layer on the lower surface side of the cover film 117, or namely the mating side, via a conducting member passing through the through hole 117*b*. To wit, the plate-shaped terminals 151 and wiring 161 are disposed upon different layers of the female connector 101, electrically connected to each other via conducting members.

In addition, the connection tip 162 and wiring connection hole 162*a* of the wiring 161 are arrayed to correspond to the plate-shaped terminals 151 arrayed in zigzag fashion offset by one half pitch from each other within the two rows. Accordingly, the wiring 161 is arrayed such that long wiring 161 at positions where its tip the connection tip 162 is at a position close to the front edge 111*a* of the main-unit portion 111 and short wiring 161 where the connection tip 162 is at a position far from the front edge 111*a* of the main-unit portion 111 are lined up alternately. Moreover, the long wiring 161 passes through mutually adjacent plate-shaped terminals 151 in rows toward the cable portion 112 when viewed from the top.

The base film 115 has terminal-corresponding openings 115*a* formed at positions corresponding to the openings 154 of each of the plate-shaped terminals 151. To wit, the terminal-corresponding openings 115*a*, like the plate-shaped terminals 151, are arrayed in zigzag fashion offset by one half pitch from each other within two rows. The terminal-corresponding openings 115*a* penetrate the base film 115 in the board thickness direction. In addition, the terminal-corresponding openings 115*a* have substantially elliptical to oval-shaped flat shapes, being formed at a size larger than the openings 154 but smaller than the external size of the plate-shaped terminals 151. Moreover, wiring-corresponding openings 115*c* that penetrate the base film 115 in the board thickness direction at positions corresponding to each wire of the wiring 161 are formed in portions corresponding to the cable portion 112 in the base film 115. A thick connection bump 161*a* formed on the non-mating-side surface of the corresponding wire of the wiring 161 is exposed to each of these wiring-corresponding openings 115*c*. This connection bump 161*a* is connected by soldering or other means to the conductor wire exposed at the tip of the flat cable (not shown) as the mounting member.

In addition, a terminal-corresponding opening 116*a* is formed also in the engagement reinforcing plate 116 at positions corresponding to each opening 154 of each plate-shaped terminal 151. To wit, the terminal-corresponding openings 116*a* are, like the plate-shaped terminals 151, arrayed in a zigzag pattern in two rows offset by one half pitch from each other. The terminal-corresponding openings 116*a* penetrate through the engagement reinforcing plate 116 in the direction of the board thickness. In addition, the terminal-corresponding openings 116*a* have substantially elliptical to oval-shaped flat shapes, being formed at a size larger than the openings 154 but smaller than the external size of the plate-shaped terminals 151. Moreover, a pair of right arms 116*b* extends backward in portions corresponding to the cable portion 112 in the engagement reinforcing plate 116. Thereby, the three directions are demarcated by a connection cavity 112*a* surrounded by the engagement reinforcing plate 116 on the non-mating surface side of the cable portion 112. The tip of the flat cable (not shown) as the mounting member is enclosed within this connection cavity 112*a*.

In addition, on both the left and right sides of the main-unit portion 111 in the engagement reinforcing plate 116, connector engagement tabs 113 extending outward in the width direction of the female connector 101 are integrally formed. When the female connector 101 mates to the male connector 1, these connector engagement tabs 113 are members that engage with the connector engagement cavities 13 of this male connector 1, serving to prevent the female connector 101 from disconnecting from the male connector 1. Moreover, an indenting detent 113*b* and a visor-shaped detent protrusion 113*a* that covers the detent 113*b* are formed at the rear end of the connector engagement tab 113 (the cable portion 112 side end). When the female connector 101 is slid relative to the male connector 1 in the direction of the front edge 11*a* of this male connector 1 in the state with the connector engagement tab 113 engaged with the connector engagement cavity 13, the detent protrusion 113*a* and detent 113*b* engage the detent cavity 13*a* and detent 13*b* of the connector engagement cavity 13, thereby preventing the connector engagement tab 113 from disconnecting from the connector engagement cavity 13.

In addition, a latch protrusion 118 that protrudes toward the outside in the width direction of the female connector 101 is formed upon the connector engagement tab 113. This latch protrusion 118 is given a triangular flat shape and is able to mate with the front-side latch cavity 18*c* and rear-side latch cavity 18*d* in the entry cavity 18*a* of the male connector 1. The inclined surface at the rear side of the triangular latch protrusion 118 (on the detent protrusion 113*a* side) preferably has a more gentle inclination than the inclined surface at the front side (the front edge 111*a* side).

Figure 6:
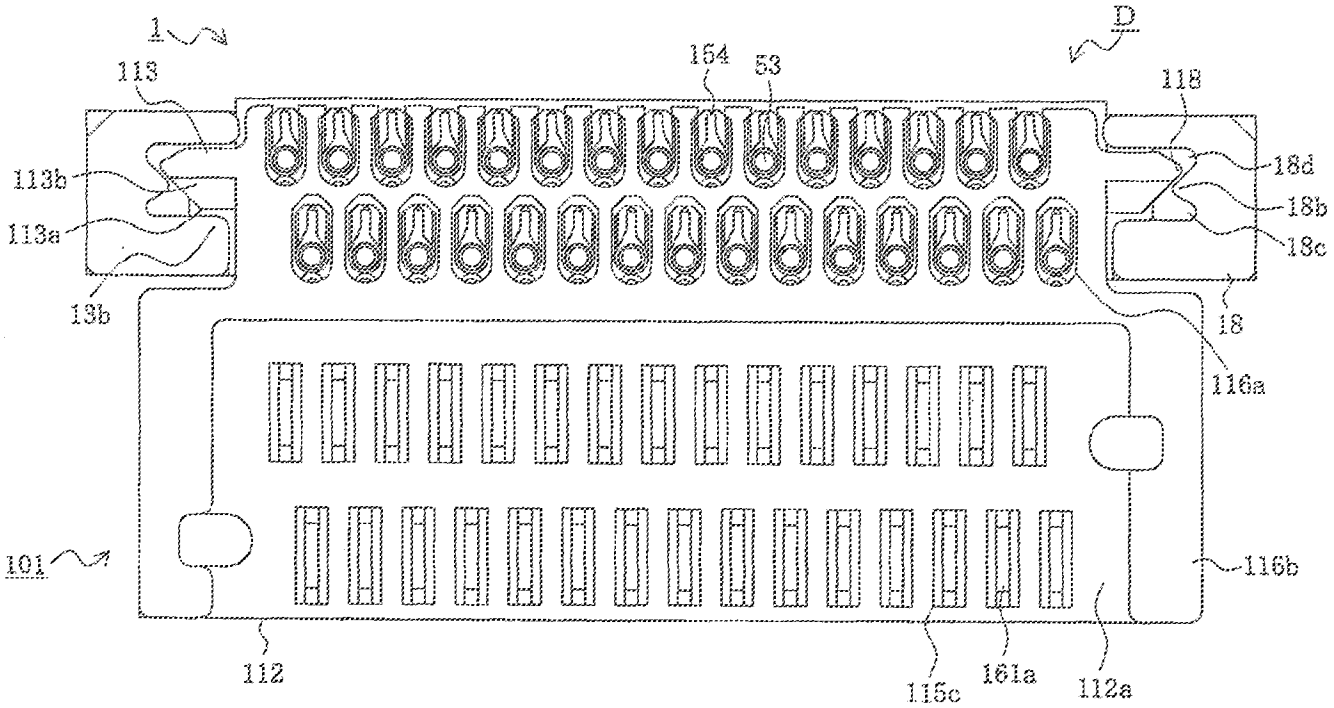
FIG. 6 is a first top view of the male connector of FIG. 1, and the process of mating with the female connector of FIG. 3.
Figure 7B:
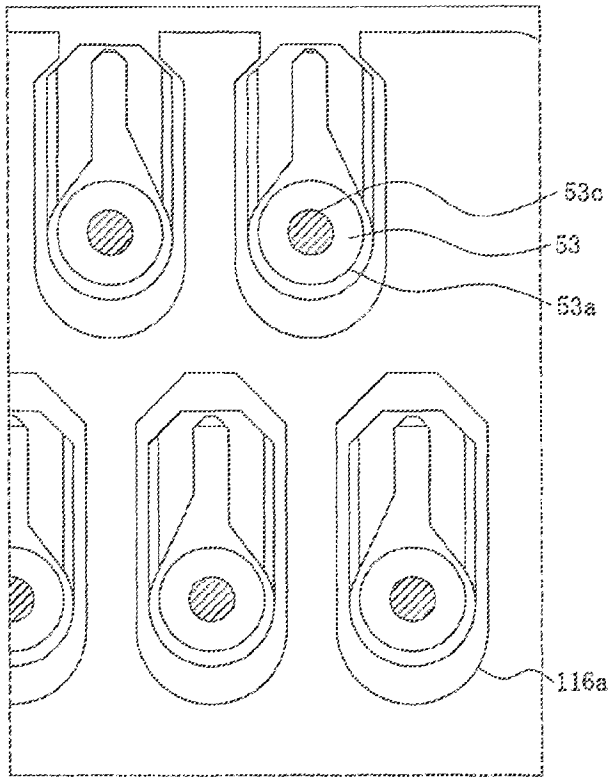
FIG. 7 is a first enlarged view of the male connector of FIG. 1, and the process of mating with the female connector of FIG. 3, being an enlargement of Area D of FIG. 6, where (a) is a view showing the non-mating surface side of the female connector, and (b) is a view showing a cross-section of the protruding terminal in (a)
Figure 7A:
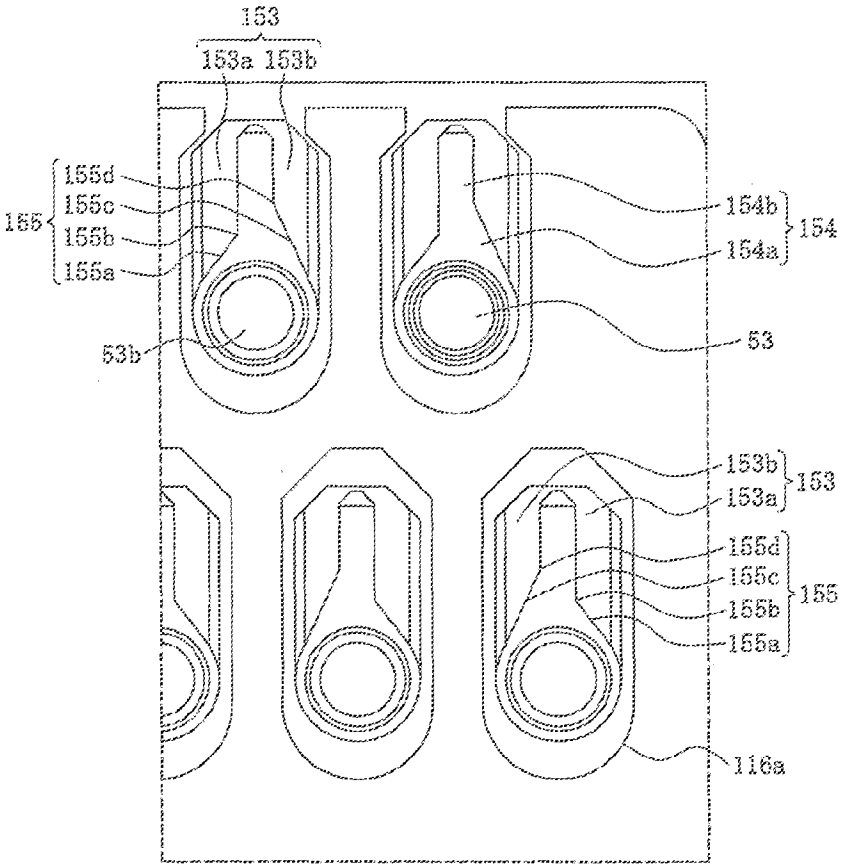

Referring to FIGS. 6-12, in mating the male connector 1 and the female connector 101, the operator places the mating surface of the male connector 1 (the top-side surface in FIG. 1) such that it faces the mating surface of the female connector 101 (the top-side surface in FIG. 3), and lowers the female connector 101 relative to the male connector 1, or namely moves it in the mating direction, thus causing the mating surface of the male connector 1 to contact or approach the mating surface of the female connector 101. Thereby, as shown in FIG. 6, the left and right connector engagement tabs 113 of the female connector 101 enter the left and right connector engagement cavities 13 of the male connector 1 and also, each of the protruding terminals 53 of the male connector 1 enter within the wide portions 154*a* in the openings 154 of the corresponding plate-shaped terminals 151 of the female connector 101. In this case, the connector engagement cavity 13 is formed such that its inside dimensions are larger than the outside dimensions of the connector engagement tab 113, so the connector engagement tab 113 can smoothly enter the interior of the connector engagement cavity 13. In addition, the rear-side latch cavity 18*d* positioned to the rear of this connector engagement cavity 13 is formed such that its inside dimensions are larger than the outside dimensions of the latch protrusion 118 of the connector engagement tab 113, so the latch protrusion 118 can smoothly enter the interior of the rear-side latch cavity 18*d*. Moreover, as shown in FIG. 7(*a*), the wide portion 154*a* is formed such that its inside dimensions are greater than the outside dimensions of the tip portion 53*b*, so the protruding terminal 53 can smoothly enter the interior of the wide portion 154*a*.

Next, the operator slides the female connector 101 relative to the male connector 1 in the direction of the front edge 11*a* of this male connector 1 (in the direction indicated by Arrow B in FIG. 3). To wit, the female connector 101 advances relative to the male connector 1 in the forward direction of this male connector 1, in the state with the mating surface of the male connector 1 in contact with or near the mating surface of the female connector 101.

Figure 8:
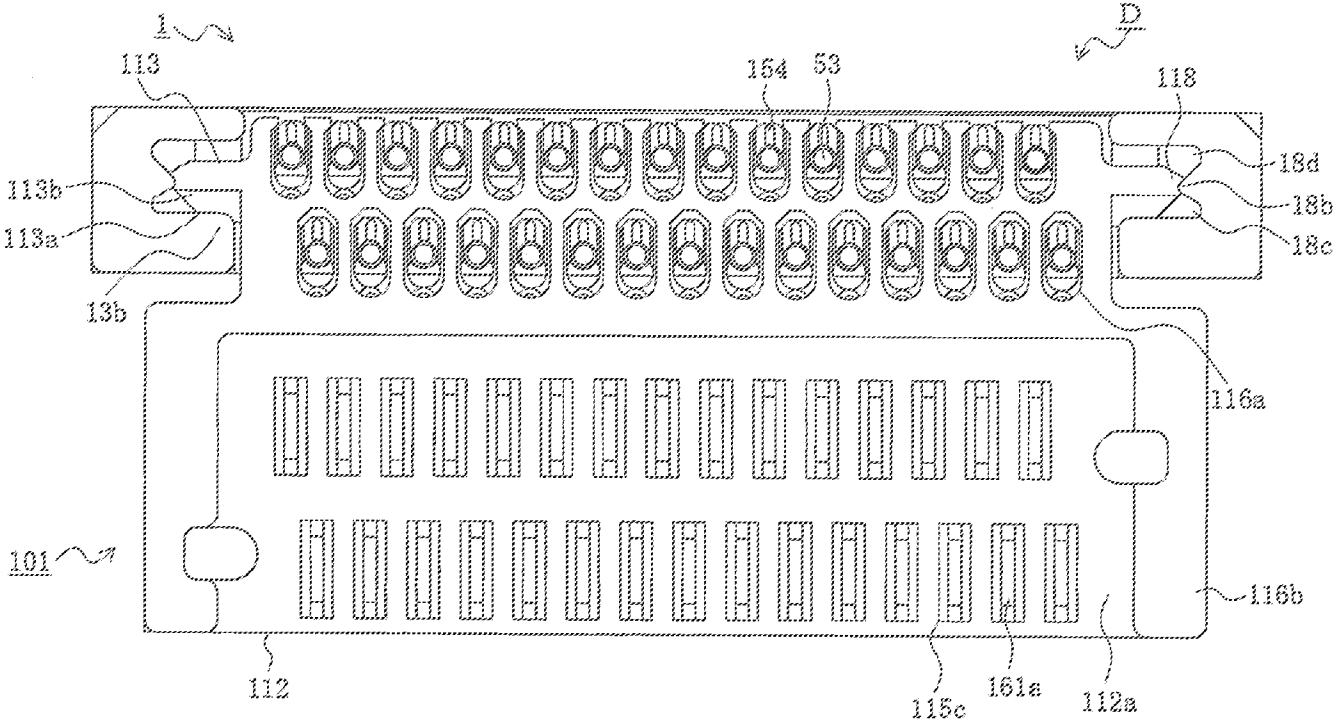
FIG. 8 is a second top view of the male connector of FIG. 1, and the process of mating with the female connector of FIG. 3.

Then, as shown in FIG. 8, the inclined surfaces on the rear side of the latch protrusion 118 at the tips of the left and right connector engagement tab 113 come into contact with the inclined surfaces on the rear side of the latch protrusion 18*b* positioned toward the front edge 11*a* of the rear-side latch cavity 18*d*. Furthermore, when the operator advances the female connector 101 further relative to the male connector 1 in the forward direction of this male connector 1, the latch protrusion 118 of the female connector 101 and/or the latch protrusion 18*b* of the male connector 1 deforms elastically, the latch protrusion 118 of the female connector 101 rides up over the latch protrusion 18*b* of the male connector 1 and enters into the interior of the front-side latch cavity 18*c* as in FIG. 10. When the latch protrusion 118 of the female connector 101 rides up over the latch protrusion 18*b* of the male connector 1 in this manner, a reaction force is generated due to the elastic deformation of the latch protrusion 118 of the female connector 101 and/or the latch protrusion 18*b* of the male connector 1. In addition, vibrations or sound may also be generated. The operator may be aware of such reaction force, vibration and/or sound as a "click" feeling. Note that the inclined surface on the rear side of the latch protrusion 18*b* (the rear-side latch cavity 18*d* side) has a gentler inclination than the inclined surface on the front side (the front-side latch cavity 18*c* side), and the inclined surface on the rear side of the latch protrusion 118 (the detent protrusion 113*a* side) has a gentler inclination than the inclined surface on the front side (the front edge 111*a* side), so the operator may make the latch protrusion 18*b* ride over the latch protrusion 118 without exerting a great force.

Figure 9B:
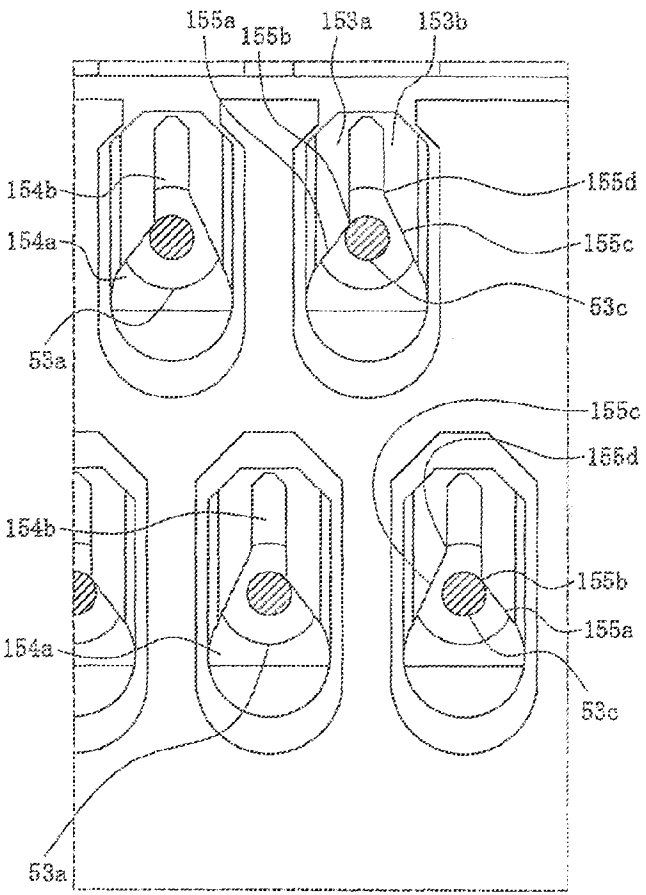
FIG. 9 is a second enlarged view of the male connector of FIG. 1, and the process of mating with the female connector of FIG. 3, being an enlargement of Area D of FIG. 8, where (a) is a view showing the non-mating surface side of the female connector, and (b) is a view showing a cross-section of the protruding terminal in (a)
Figure 9A:
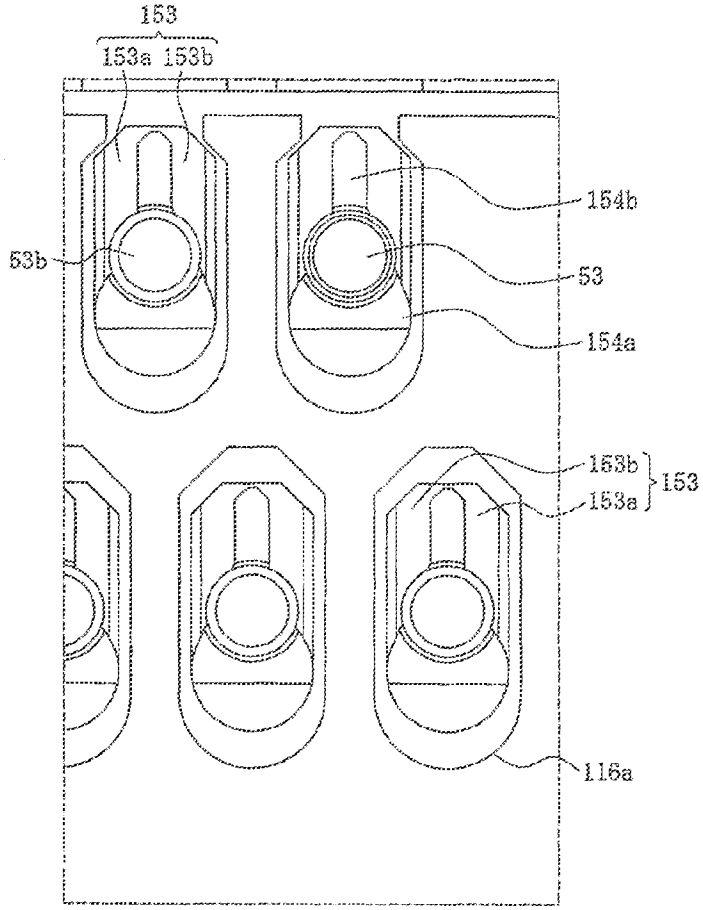
Figure 11B:
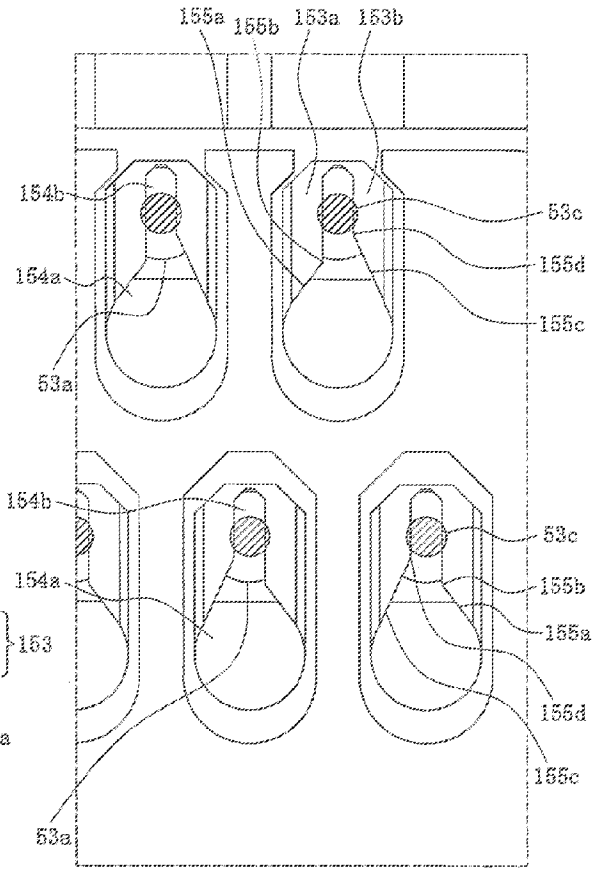
FIG. 11 is a third enlarged view of the male connector of FIG. 1, and the process of mating with the female connector of FIG. 3, being an enlargement of Area D of FIG. 10, where (a) is a view showing the non-mating surface side of the female connector, and (b) is a view showing a cross-section of the protruding terminal in (a)
Figure 11A:
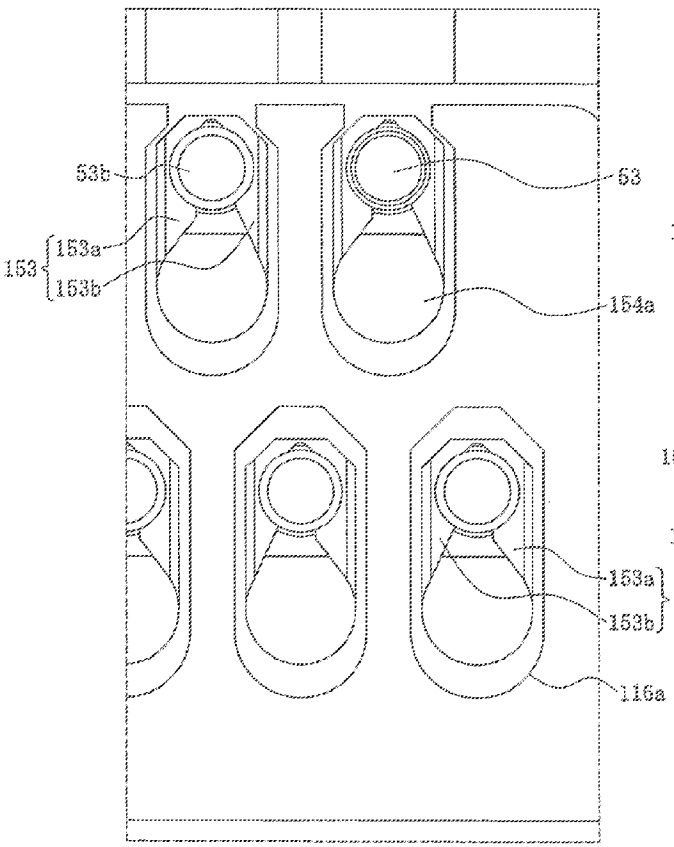

The protruding terminals 53 positioned within the wide portions 154*a* in the openings 154 of the plate-shaped terminals 151 move relative toward the narrow portion 154*b*. One side of the transitional portion 155 in the opening 154 (the left side in the plate-shaped terminals 151 within the row along the front edge 111*a*, or the right side in the plate-shaped terminals 151 within the row toward the cable portion 112) is provided with a first inclined portion 155*a* and first vertex 155*b*, while the other side is provided with a second inclined portion 155*c* and second vertex 155*d*. As described above, the first inclined portion 155*a* has a steeper inclination than the second inclined portion 155*c*, and the first vertex 155*b* is positioned behind the second vertex 155*d* (toward the cable portion 112). For this reason, as shown in FIG. 9(*b*), the side wall portions 53*c* of the protruding terminals 53 first come into contact with the first inclined portion 155*a* and first vertex 155*b*. Then, when the operator further advances the female connector 101 relative to the male connector 1 in the forward direction thereof, the side wall portions 53*c* of the protruding terminals 53 continue to be in contact with the second inclined portion 155*c* and second vertex 155*d* and then enter into the interior of the narrow portion 154*b* as shown in FIG. 11(*b*).

Even if there is positioning error in the openings 154 and/or protruding terminals 53 due to the effects of manufacturing tolerances or the like, the side wall portions 53*c* of the protruding terminals 53 always first come into contact with the first inclined portion 155*a* and first vertex 155*b* so the first arm 153*a*, which is the arm 153 on the side where the first inclined portion 155*a* and first vertex 155*b* are formed, starts to elastically deform before the second arm 153*b* which is the other arm 153, so the positioning error can be absorbed. In addition, in the row along the front edge 111*a* and the row toward the cable portion 112, the first inclined portion 155*a* and first vertex 155*b* are at positions with left/right reversed, so the force in the lateral direction that the protruding terminals 53 and plate-shaped terminals 151 receive mutually from the other half is equalized over the whole. Accordingly, the states of the male connector 1 and female connector 101 mating to each other are stable, and all of the protruding terminals 53 and plate-shaped terminals 151 are stably in contact with no occurrence of the so-called "tilted mating."

Moreover, when the protruding terminals 53 enter within the narrow portions 154*b*, the arms 153 on both sides come into contact with the side wall portions 53*c* of the protruding terminals 53 and are elastically displaced so that the gap between is widened. Accordingly, the protruding terminals 53 are subject to contact pressure from the arms 153, and thus the continuity between the protruding terminals 53 and plate-shaped terminals 151 is reliably maintained.

Figure 10:
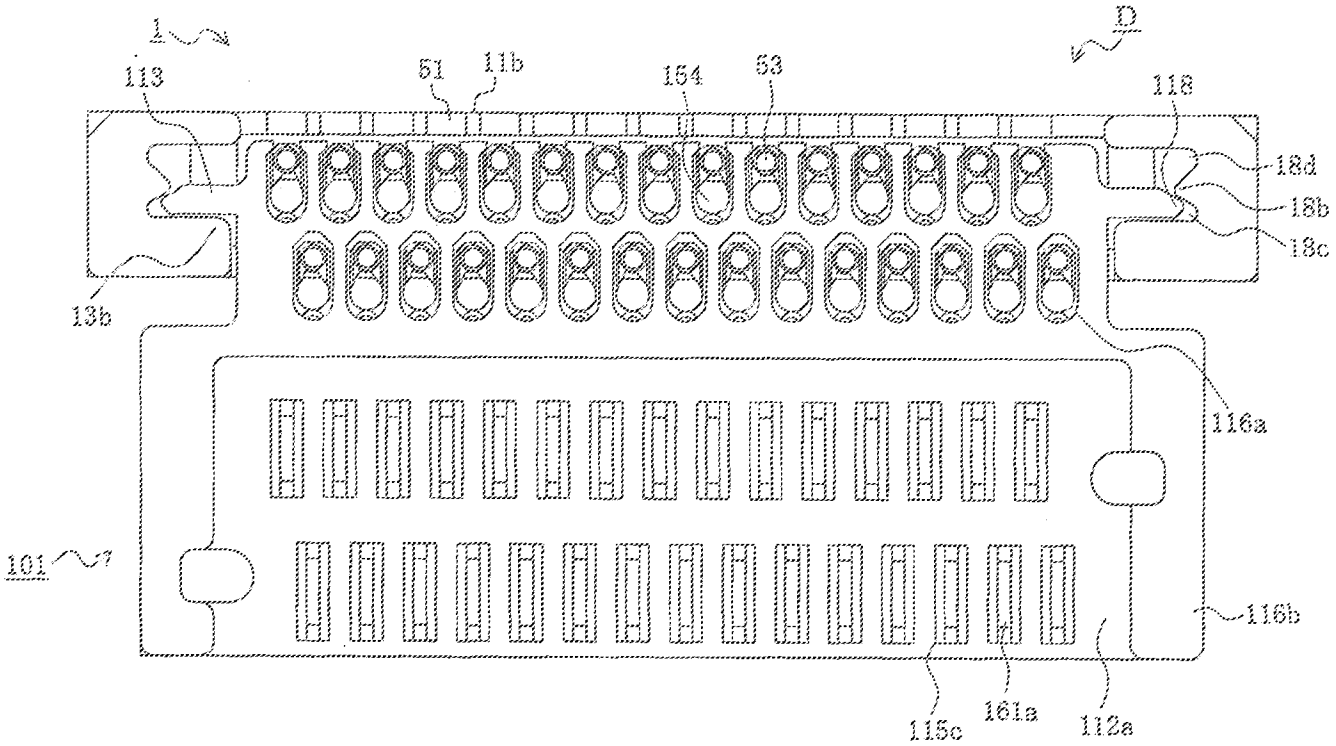
FIG. 10 is a third top view of the male connector of FIG. 1, and the process of mating with the female connector of FIG. 3.
Figure 12:
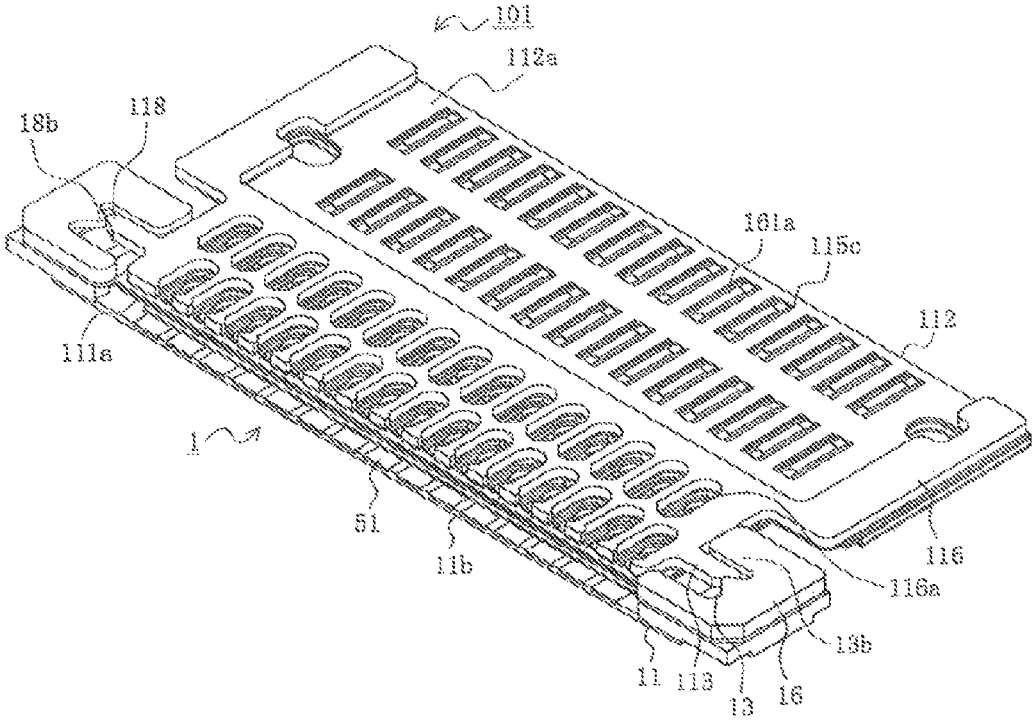
FIG. 12 is a perspective view of the state in which the mating of the male connector of FIG. 1 and female connector of FIG. 3 is complete.
Figure 13:
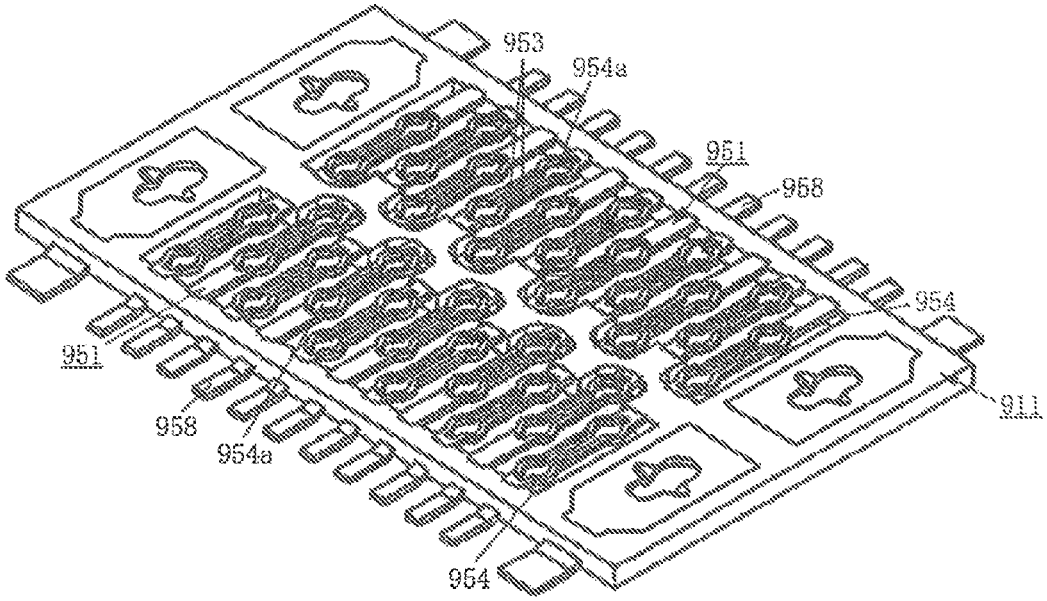
Prior art FIG. 13
FIG. 13 is a perspective view of a conventional connector.

When the mating of the male connector 1 and female connector 101 is complete in this manner, as shown in FIGS. 10 and 12, the detent protrusion 113*a* and detent 113*b* of the connector engagement tab 113 engage the detent cavity 13*a* and detent 13*b* of the connector engagement cavity 13 and are held. Thereby, disconnection of the connector engagement tab 113 from the connector engagement cavity 13 is prevented, and any release of the mating between the male connector 1 and female connector 101 is reliably prevented. In addition, the latch protrusion 118 enters the interior of the front-side latch cavity 18*c*, engages and is held. This prevents the female connector 101 from sliding with respect to the male connector 1 in the direction of releasing the mating (the direction opposite the direction indicated by Arrow B in FIG. 3), so any release of the engagement between the detent protrusion 113*a* and detent 113*b* of the connector engagement tab 113 and the detent cavity 13*a* and detent 13*b* of the connector engagement cavity 13 is reliably prevented. Note that the inclined surface on the front side (the front-side latch cavity 18*c* side) of the latch protrusion 18*b* has a steeper inclination than the inclined surface on the rear side (the rear-side latch cavity 18*d* side), and the inclined surface on the front side (the front edge 111*a* side) of the latch protrusion 118 has a steeper inclination than the inclined surface on the rear side (the detent protrusion 113*a* side). For this reason, a relatively large amount of force must be applied in order to cause the latch protrusion 118 to ride up over the latch protrusion 18*b* of the male connector 1 and enter within the rear-side latch cavity 18*d*, and thus slide the female connector 101 toward the male connector 1 in the direction of releasing the mating. Accordingly, any sliding of the female connector 101 toward the male connector 1 in the direction of releasing the mating is reliably prevented.

Note that the operation of releasing the mating between the male connector 1 and the female connector 101 is nothing more than the opposite of the operation of mating the male connector 1 to the female connector 101, so an explanation thereof is omitted.

In addition, this embodiment was described in the case in which there are two rows of conductor patterns 51 and plate-shaped terminals 151, but the number of these rows is in no way limited to two, but rather it may be any number as long as it is a plurality. Moreover, it is sufficient for the conductor patterns 51 of one row to be offset in position in the width direction of the main unit 11 from the conductor patterns 51 of the adjacent row, and it is sufficient for the plate-shaped terminals 151 of one row to be offset in position in the width direction of the main unit 11 from the plate-shaped terminals 151 of the adjacent row. Moreover, this embodiment describes the case in which only the plate-shaped terminals 151 are connected to the wiring 161, but the conductor patterns 51 may also be connected to the wiring 161. To wit, it is sufficient for at least one of the terminal members of the male connector 1 and female connector 101 to be connected to the tips of the parallel wires of the wiring 161.

In this manner, in this embodiment the connector has a plurality of plate-shaped terminals 151 including openings 154 that are able to enclose the protruding terminals 53 of the male connector 1, and a female connector 101 that mates with the male connector 1. Moreover, each of the openings 154 comprise a wide portion 154*a*, a narrow portion 154*b* and a transitional portion 155 that transitions from the wide portion 154*a* to the narrow portion 154*b*, and in a top view, are provided with a first shape that is left-right asymmetric with respect to the centerline C of the plate-shaped terminals 151, or a second shape whereby the first shape is inverted about the centerline; and the plate-shaped terminals 151 are arrayed lined up in the width direction of the connector 101, and arrayed such that the plate-shaped terminals 151 comprising the opening 154 having the first shape and the plate-shaped terminals 151 comprising the opening having the second shape alternate.

Accordingly, any positioning errors of the protruding terminals 53 and plate-shaped terminals 151 can be appropriately absorbed, so it is possible to prevent excessive shaving or deformation of the protruding terminals 53 or plate-shaped terminals 151, and thus it is possible to increase its reliability while still remaining compact and low profile. In addition, the transitional portion 155 also comprises a first vertex 155*b* formed on either the left or right side of the Centerline C, and a second vertex 155*d* formed on the other side, so each protruding terminal 53, when moving from the wide portion 154*a* to the narrow portion 154*b*, first comes into contact with the first vertex 155*b* and then comes into contact with the second vertex 155*d*. Accordingly, the protruding terminals 53 always first come into contact with the first vertex 155*b* so the first arm 153*a* where the first vertex 155*b* is formed starts to elastically deform before the second arm 153*b*, so the positioning error can be absorbed.

Moreover, the transitional portion 155 comprises a first inclined portion 155*a* connected to the first vertex 155*b*, an a second inclined portion 155*c* connected to the second vertex 155*d*, and the first inclined portion 155*a* and second inclined portion 155*c* are inclined portions that are inclined with respect to the Centerline C, where the inclination of the first inclined portion 155*a* is steeper than that of the second inclined portion 155*c*.

Moreover, the plate-shaped terminals 151 are arrayed lined up so as to form a plurality of rows extending in the width direction of the female connector 101, and the rows are formed so as to form rows made up of plate-shaped terminals 151 comprising openings 154 that are given the first shape and rows made up of plate-shaped terminals 151 comprising openings 154 that are given the second shape. Accordingly, the force in the lateral direction that the protruding terminals 53 and plate-shaped terminals 151 receive mutually from the other half is equalized over the whole, so the states of the male connector 1 and female connector 101 mating to each other are stable, and all of the protruding terminals 53 and plate-shaped terminals 151 are stably in contact with no occurrence of the so-called "tilted mating."

Moreover, the plate-shaped terminals 151 comprising openings 154 that are given the first shape and the plate-shaped terminals 151 comprising openings 154 that are given the second shape are arrayed so as to alternate with regard to the width direction of the female connector 101. Accordingly, the force in the lateral direction that the protruding terminals 53 and plate-shaped terminals 151 receive mutually from the other half is equalized over the whole, so the states of the male connector 1 and female connector 101 mating to each other are stable, and all of the protruding terminals 53 and plate-shaped terminals 151 are stably in contact with no occurrence of the so-called "tilted mating."

Moreover, the female connector 101 also has a connector engagement tab 113 extending toward the outside in the width direction, and a latch protrusion 118 extending toward the outside in the width direction of the female connector 101 is formed on the connector engagement tab 113, and the male connector 1 has connector engagement cavities 13 that are disposed on both sides in the width direction and that engage with the connector engagement tab 113, while a latch protrusion 18*b* that protrudes toward the center in the width direction of the male connector 1 is formed on the connector engagement cavity 13, so when the male connector 1 is moved relative to the female connector 101 in the direction that the protruding terminals 53 enclosed within the openings 154 moves from the wide portion 154*a* to the narrow portion 154*b*, the latch protrusion 118 rides up over the latch protrusion 18*b*. Accordingly, the operator may be made aware of such reaction force, vibration and/or sound as a "click" feeling.

While a preferred embodiment of the Present Disclosure is shown and described, it is envisioned that those skilled in the art may devise various modifications without departing from the spirit and scope of the foregoing Description and the appended Claims.

What is claimed is:

1. A connector, the connector including two halves, the connector comprising:

a first half and a second half; and a plurality of plate-shaped terminals disposed on the first half for mating with the second half, each plate-shaped terminal including an opening able to enclose a corresponding protruding terminal of the second half;

wherein: each opening includes a wide portion, a narrow portion and a transitional portion that transitions from the wide portion to the narrow portion, and, in a top view, are provided with a first shape and a second shape, the first shape being left-right asymmetric with respect to the centerline of the plate-shaped terminals and inverted about the centerline; and each of the plate-shaped terminals is arrayed in the width direction of the connector, such that they include a first opening including the first shape and a second opening including the second shape.

2. The connector of claim 1, wherein each transitional portion includes an early contact portion formed upon either side of the centerline and a late contact portion formed upon the other side.

3. The connector of claim 2, wherein, in operation, when moving from the wide portion to the narrow portion, the protruding terminals initially contact the early contact portions and then contact the late contact portions.

4. The connector of claim 3, wherein each transitional portion includes an early induction portion connected to the early contact portion and a late induction portion connected to the late contact portion, the induction portions being inclined with respect to the centerline, the inclination of the early induction portion being steeper than that of the late induction portion.

5. The connector according to claim 4, wherein the plate-shaped terminals are arrayed to form a plurality of rows extending in the width direction of the connector, the rows being formed such that rows made up of plate-shaped terminals including openings of the first shape alternate with rows made up of plate-shaped terminals including openings of the second shape.

6. The connector according to claim 5, wherein the plate-shaped terminals including openings of the first shape and the plate-shaped terminals including openings of the second shape are defined to alternate with respect to the width direction of the connector.

7. The connector according to claim 6, wherein the connector further includes a connector engagement tab extending toward the outside in the width direction.

8. The connector according to claim 7, wherein a latch protrusion protruding toward the outside in the width direction of the connector is formed upon the connector engagement tab.

9. The connector according to claim 8, wherein the second half includes connector engagement cavities, that engage the connector engagement tab disposed on either side in the width direction.

10. The connector according to claim 9, wherein second half latch protrusions that protrude toward the center in the width direction of the second half are formed upon the connector engagement cavities.

11. The connector according to claim 10, wherein, when the second half is moved relative to the connector in the direction such that the protruding terminals enclosed within the openings move in the direction from the wide portions to the narrow portions, the latch protrusions ride up over the second half latch protrusions.

12. The connector according to claim 1, wherein the plate-shaped terminals are arrayed to form a plurality of rows extending in the width direction of the connector, the rows of plate-shaped terminals having including openings of the first shape alternate with rows of plate-shaped terminals having openings of the second shape.

13. The connector according to claim 1, wherein the plate-shaped terminals including openings of the first shape and the plate-shaped terminals including openings of the second shape are defined to alternate with respect to the width direction of the connector.

14. The connector according to claim 1, wherein the connector further includes a connector engagement tab extending toward the outside in the width direction.

15. The connector according to claim 14, wherein a latch protrusion protruding toward the outside in the width direction of the connector is formed upon the connector engagement tab.

16. The connector according to claim 15, wherein the second half includes connector engagement cavities, that engage the connector engagement tab disposed on either side in the width direction.

17. The connector according to claim 16, wherein second half latch protrusions that protrude toward the center in the width direction of the second half are formed upon the connector engagement cavities.

18. The connector according to claim 17, wherein, when the second half is moved relative to the connector in the direction such that the protruding terminals enclosed within the openings move in the direction from the wide portions to the narrow portions, the latch protrusions ride up over the second half latch protrusions.

19. A connector, comprising:

first and second interengaging connector halves, the first connector half including a plurality of first terminals and the second connector half including a plurality of second terminals, the first terminals including openings and the second terminals including projecting ends which are received within the first terminal openings when the first and second connector halves are engaged;

each of the first terminal openings including a wide portion, a narrow portion and a transition portion interconnecting the wide and narrow portions together, and the wide, narrow and transition portions cooperatively defining asymmetrical profiles of the first terminal openings with respect to centerlines of the first terminal openings, the first terminals being arranged on the first connector half in distinct rows, the asymmetrical profiles of one row of the first terminal openings being aligned together in one direction and the asymmetrical profiles of profile of the row adjacent the one row of first terminal openings being aligned together in an opposite direction.

20. The connector of claim 19, wherein each of the first terminal openings includes a wide part, a narrow part and a transition part linking the wide and narrow parts together, the transition portion including two angled portions, the two angled portions meeting the narrow part at respective first and second vertexes which are spaced longitudinally apart from each other along the length of the first terminal opening.

* * * * *